US005544460A

United States Patent [19]

Fife

[11] Patent Number: 5,544,460

[45] Date of Patent: Aug. 13, 1996

[54] MULTI-COMPONENT FLUID TANK

[75] Inventor: Jerome J. Fife, Occidental, Calif.

[73] Assignee: Janice Faye Fife, Occidental, Calif.

[21] Appl. No.: 220,785

[22] Filed: Mar. 31, 1994

[51] Int. Cl.[6] ..... B65D 8/04; B65D 88/76; B65D 90/08; E04C 5/08

[52] U.S. Cl. ..... 52/223.3; 52/21; 52/169.6; 52/223.7; 210/532.2; 220/4.26

[58] Field of Search ..... 52/223.6, 223.7, 52/223.2, 223.3, 223.4, 223.5, 21, 169.6, 245; 220/4.07, 4.12, 4.26; 405/126; 138/176; 210/532.2

[56] References Cited

U.S. PATENT DOCUMENTS

| | | | |
|---|---|---|---|
| 429,041 | 5/1890 | Lynch | 52/245 X |
| 1,230,383 | 6/1917 | Cox | 405/126 X |
| 1,281,528 | 10/1918 | Davis . | |
| 1,422,674 | 7/1922 | Cook . | |
| 1,601,755 | 10/1926 | Hooker | 210/523.2 |
| 1,638,869 | 8/1927 | Moss | 210/532.2 |
| 1,715,466 | 6/1929 | Miller . | |
| 1,936,842 | 11/1933 | Jewell | 138/176 X |
| 1,953,006 | 3/1934 | Norris | 138/176 X |
| 2,037,151 | 4/1936 | Safford | 220/4.07 |
| 2,184,137 | 12/1939 | Brewer | 52/223.7 |
| 2,364,472 | 12/1944 | Piatt . | |
| 2,384,994 | 9/1945 | Gutman et al. . | |
| 2,412,785 | 12/1946 | Torricelli . | |
| 2,764,545 | 9/1956 | Primich . | |
| 2,903,875 | 9/1959 | Bonatz et al. | 52/169.6 |
| 3,111,811 | 11/1963 | Eggink et al. | 52/223.3 X |
| 3,286,870 | 11/1966 | Foelsch | 220/4.12 |
| 3,371,488 | 3/1968 | Turner | 220/4.12 |
| 3,426,903 | 2/1969 | Olecko . | |
| 3,462,896 | 8/1969 | Lokensgaard | 52/223.3 |
| 3,465,527 | 9/1969 | Rohmer | 405/33 |
| 3,472,031 | 10/1969 | Kelso | 52/169.9 X |
| 3,891,224 | 6/1975 | Ditcher | 52/21 |
| 3,899,891 | 8/1975 | Kelly et al. | 405/251 |
| 4,199,994 | 4/1980 | Beine et al. | 52/223.2 X |
| 4,317,317 | 3/1982 | Kilts et al. | 52/223.3 |
| 4,627,203 | 12/1986 | Presswalla et al. | 52/223.16 |
| 4,710,295 | 12/1987 | Zabel | 210/532.2 X |
| 4,910,940 | 3/1990 | Grady, II | 52/223.5 X |
| 4,961,293 | 10/1990 | House et al. | 52/223.6 X |
| 4,961,670 | 10/1990 | McKenzie et al. . | |
| 5,104,542 | 4/1992 | Dixon et al. . | |
| 5,193,714 | 3/1993 | Carey | 220/4.26 X |
| 5,429,752 | 7/1995 | Presby | 210/532.2 X |

FOREIGN PATENT DOCUMENTS

| | | | |
|---|---|---|---|
| 2159960 | 6/1973 | Germany | 52/245 |
| 783624 | 9/1957 | United Kingdom | 405/251 |
| 2124277 | 2/1984 | United Kingdom | 405/126 |

OTHER PUBLICATIONS

"Flexible–Joint Concrete Pipe Laid Below water in Lake Erie", Engineering News–Record vol. 79, No. 19, Nov. 1917.

T. Y. Ln and N. H. burns, "Design of Prestressed Concrete Structures, Third Edition", Chapter 3, pp. 67–86, published by John Wiley & Sons (1971).

*Primary Examiner*—Carl D. Friedman
*Assistant Examiner*—Laura A. Saladino
*Attorney, Agent, or Firm*—Limbach & Limbach L.L.P.

[57] ABSTRACT

A fluid-tight tank is composed of a plurality of separate components. Each component is preferably formed from cement and provided with an interior region having a circular cross-section. Each component has a plurality of chase ways extending throughout its length. Post-tension cables are routed through these chase ways and are tightened so as to compress the components together so they act as one integral unit. Each component is has an annular flange-like protrusion and/or recess so that adjacent components can be aligned with one another while maintaining the circular cross-section quality throughout the entire length of the interior region. One or more of the components can be provided with a wall to separate one interior region with another.

14 Claims, 3 Drawing Sheets

MULTI-COMPONENT FLUID TANK

FIELD OF THE INVENTION

This invention relates to multi-component precast concrete tanks that may be used as small-scale septic tanks, commercial or public sewer settling tanks, grease intercepts, and sumps for winery discharge. This invention can also be applied to any large-scale systems.

BACKGROUND OF THE INVENTION

Multicomponent precast concrete tanks would be useful in geographical areas where on site sewage treatment and disposal is required but standard 1200 gallon or larger precast concrete septic tanks cannot be installed because the heavy lifting and transporting equipment cannot access the disposal site. To date, in these areas, lightweight fiberglass tanks, or an equal, are installed because they can be lifted and installed by hand. Fiberglass tanks are subject to failure to a much higher degree than concrete tanks and therefore are less desirable. Furthermore, some jurisdiction will not allow the installation of fiberglass tanks.

Multicomponent precast concrete tanks can be designed and manufactured so that the components will be sufficiently light to allow the standard construction backhoe to pick up the components from the delivery vehicle, carry them to the disposal site, lower them into the hole and align them for cabling. A small mobile crane could also perform this job.

There are many situations where the replacement of an existing septic tank or the addition of another septic tank is necessary in an area of mature landscaping. The standard precast concrete septic tank that is delivered and placed by large, heavy duty lifting equipment would cause extensive damage to the landscaping beyond the scope of damage caused by the construction backhoe digging the holes. This is especially true if any turning or maneuvering is required. Most septic tank systems are designed to be installed behind the residence or building with the tank placed between 5 and 15 feet from the residence or building. The components could be brought to the site by the construction backhoe that dug the placement hole causing no more damage than is necessary by the smallest piece of equipment.

Multicomponent precast concrete tanks could be designed into any transportable component size that would allow movement over roads and highways. The size could meet the needs of any residential, commercial or public utility use that cast in place concrete tanks could not meet.

Multi-component tanks have been known in the prior art, but none of them have the advantages or features particular to the present invention. For example, U.S. Pat. No. 1,715,466 to Miller discloses a multiple unit septic tank that can be assembled to any desired length by selecting the number of units needed. The individual units are connected by aligning a flange, with a tapered opening, of one unit with a smaller, tapered flange of another unit. Each flange is provided with a groove such that the groove of one flange mates with the groove of the other flange. Grout or plaster is poured into this groove to secure the two units together in alignment and to seal the two together. This septic tank suffers the problems associated with the settling of the ground beneath the separate units. Each unit is only directly connected with an adjacent unit. Therefore, there is no structural integrity between two units that are separated by an intermediate unit. Furthermore, these units are placed into the ground vertically as opposed to being laid horizontally and connected serially with the circular openings of each unit cooperating with the circular openings of other units, which is a way that provides more strength.

Another sectional tank is shown by U.S. Pat. No. 1,422,674 to Cook. Cook discloses rectangular tanks that are connected side to side. These tanks also lack the structural integrity and the strength of the tanks of the present invention.

SUMMARY OF THE INVENTION

The present invention overcomes the problems of the prior art by providing a modular tank unit having multiple components in which each component has a general cylindrical outer shape, with an interior region having an uninterrupted, circular cross-section. Each of the components making up the overall tank is commonly connected to a set of post tension cables that can be designed to provide an active joint to meet the design criteria of the tank due to the tensioning properties of post tension technology. These post tension cables are routed through chase ways in each component. Tension is placed on the cables using the standard post tension pump, ram and wedges common to post tension technology. This provides a fluid tight seal between each component and provides structural integrity throughout the entire tank. The components can be assembled to form a tank, of any size, to hold fluids. Examples of its uses include, but are not limited to, septic tanks, public sewer settling tanks, grease intercepts, and sumps for winery discharge.

DETAILED DESCRIPTION OF THE PREFERRED EMBODIMENTS

Figure 1:
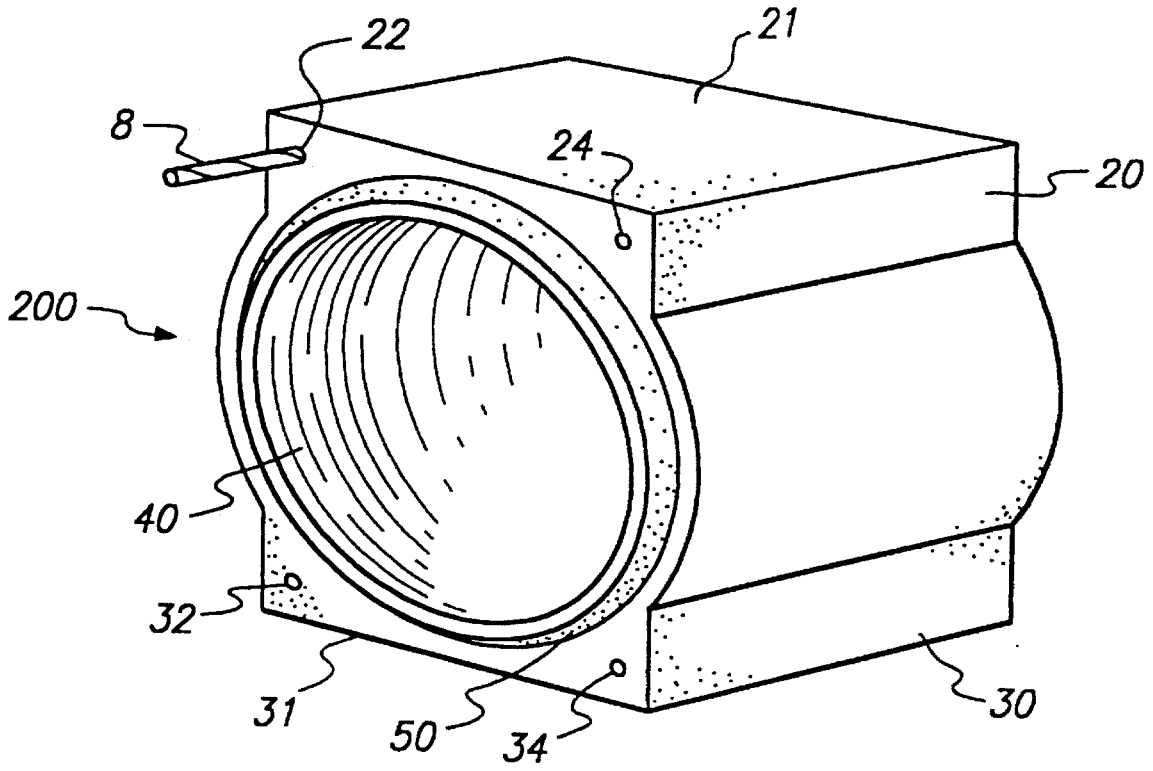
FIG. 1 shows an isometric view of an intermediate component according to the present invention.

FIG. 1 shows an exemplary component 200 of the fluid tank according to the present invention. Component 200 has a perfectly cylindrical interior defining an interior region 40, and a generally cylindrical exterior except for rectangular regions referred to as a top 20 and a bottom 30. The top 20 and bottom 30 are rectangular regions formed on the outside of the component and have a width that is approximately equal to the diameter d (see FIG. 4) of the interior region. The top 20 and bottom 30 are positioned diametrically opposite to one another along the component's outer surface. Top 20 has a flat surface 21 which is parallel to bottom surface 31 of bottom 30. Preferably, the minimum thicknesses of the top 20 and the bottom 30 are the same as the thickness of the cylindrical body wall in the lateral areas not surrounded by the top 20 and bottom 30. If the minimum thicknesses of the top 20 and bottom 30 are greater than the thicknesses of the cylindrical body wall, the amount of material required to manufacture the component is greatly increased with little benefit in structural integrity of the component. This added material increases the cost of the component. Moreover, the added weight due to the extra material impairs the transportability of the component and generally makes the component more difficult to work with.

Conversely, if the minimum thickness of the top 20 and bottom 30 is decreased below the thickness of the cylindrical body wall, the structural integrity of the component is greatly compromised with very little savings in material costs.

The approximate equality of the widths of the top 20 and bottom 30 and the diameter d of the interior region is an important attribute of the present invention. If the width of the top 20 and bottom 30 is increased to a level greater than the inner diameter d, the amount of material necessary to construct the component increases dramatically with correspondingly little benefit in the structural integrity of the component.

Figure 4:
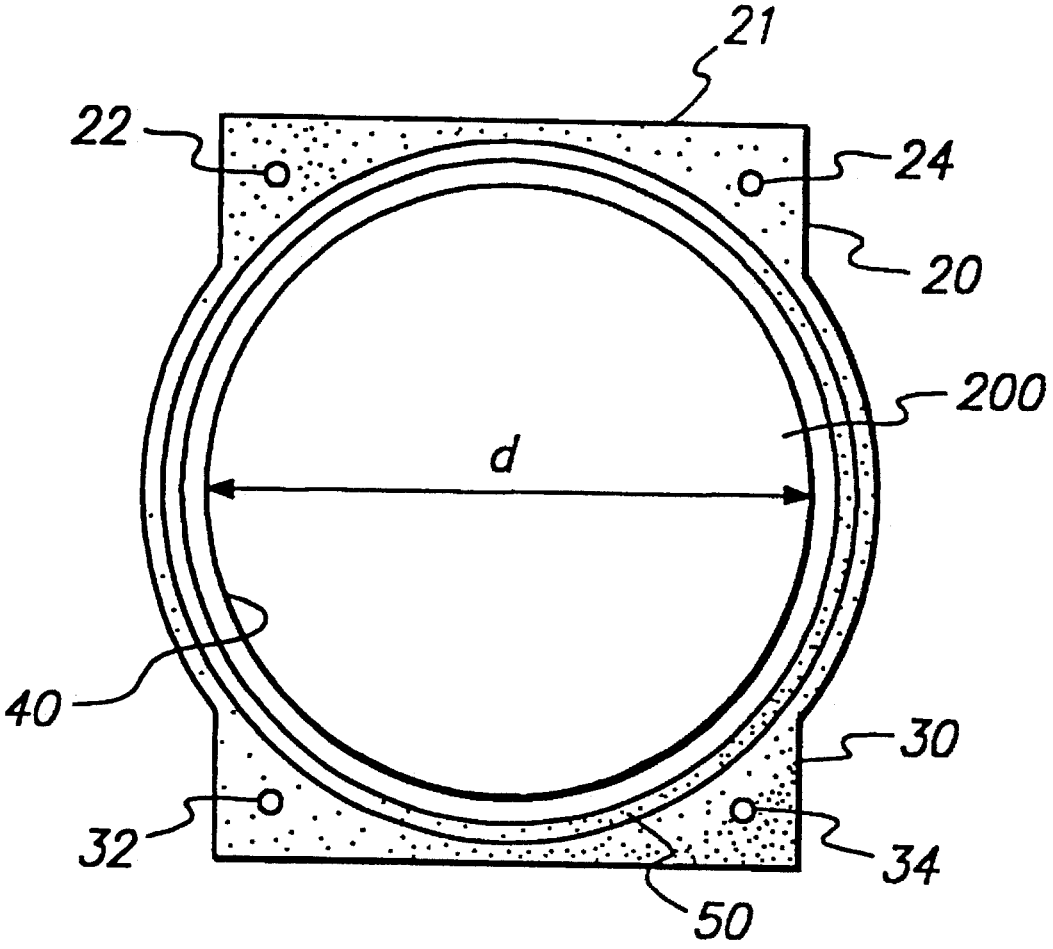
FIG. 4 is an end view of the component of FIG. 1.

The uninterrupted, circular cross-section of the interior region 40 provides added strength and makes the tank capable of withstanding outside pressure better than a tank with an interior region that has its circularity interrupted. One end of the component 200 has a protruding circular flange 50 that can be aligned with the recessed area on another component to form a fluid tight seal once the two components are compressed together (this is discussed in more detail in conjunction with FIG. 2). Component 200 is provided with two chase ways 22 and 24 formed in top 20 and two chase ways 32 and 34 formed in bottom 30, through which post tension cables 8 are routed. These chase ways extend throughout the length of component 200. An end view of the component of FIG. 1 is shown in FIG. 4.

Figure 2:
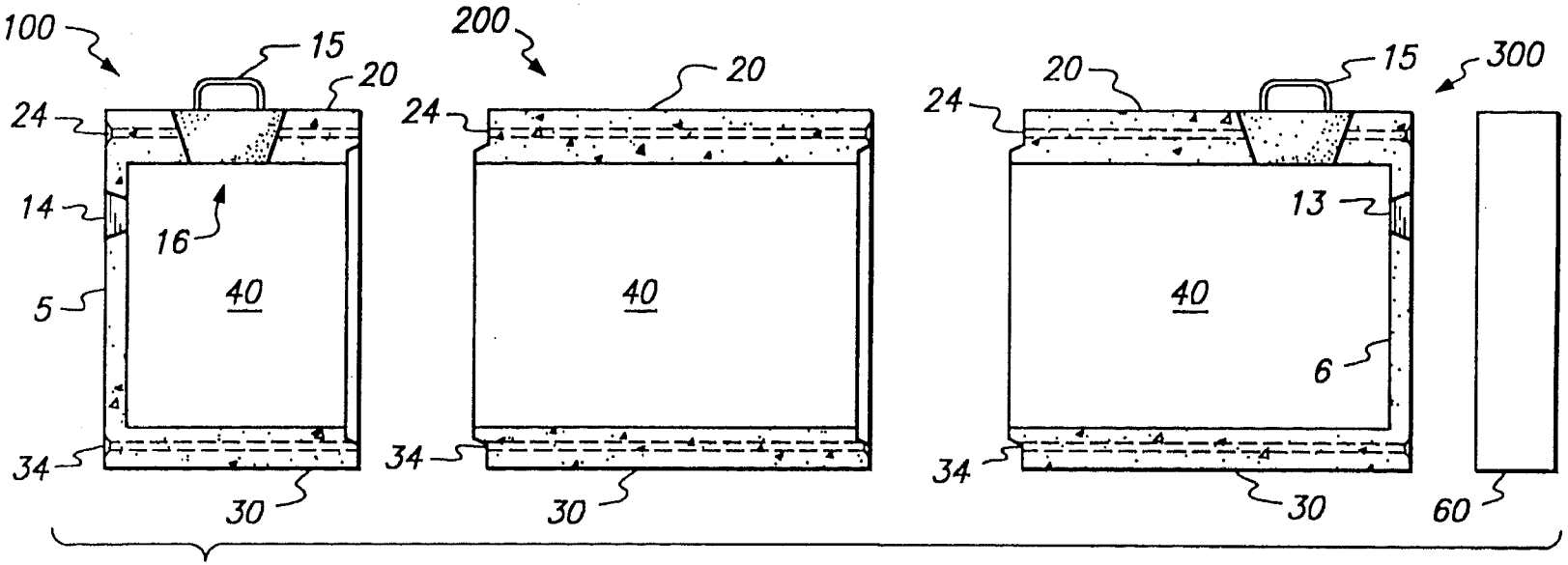
FIG. 2 is a sectional view of a line of components.

As shown in FIG. 2, each component may be assembled in a series to form a tank of any size. Components 100 and 300 have ends 5 and 6, respectively. End 5 is provided with an opening 14 that can be used as an outlet while opening 13 in end 6 can be used as an inlet. Components 100 and 300 are provided with a disk shaped opening 16 of sufficient diameter to satisfy local codes and having a cast lid 15 on top. The openings 16 give easy access to the inlet and the outlet of components 100 and 300. Component 200, which was discussed with reference to FIG. 1, is shown in FIG. 2 as an intermediate component. Any number of such components may be placed between components 100 and 300 depending upon size requirements.

Figure 3:
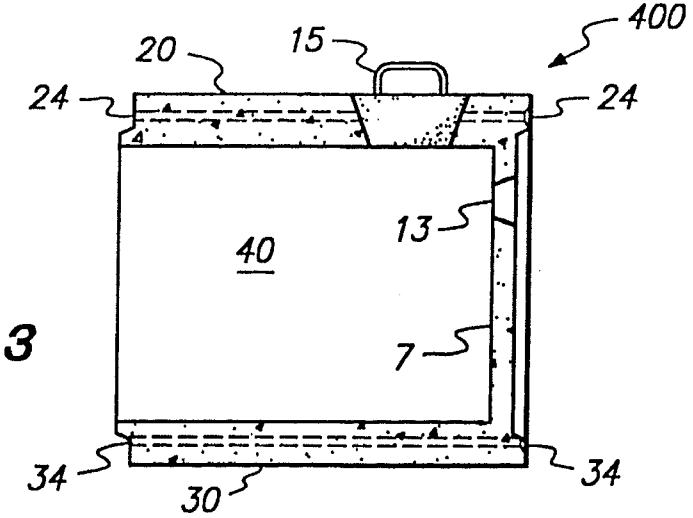
FIG. 3 is a sectional view showing an alternate embodiment of the invention in which a component is provided with a wall so that it can be used as an end unit or as an intermediate unit as in a dual chambered tank.

In FIG. 3, an alternate embodiment of one of the end components is shown as component 400. Component 400 can be used as either an end or a middle. It is particularly useful as a middle where it is desired to have a wall 7 between one section of the tank and another. Such a wall is necessary when the components are assembled to form a dual-chambered septic tank.

A dual-chambered septic tank requires an inlet chamber and an outlet chamber. Preferably the inlet chamber has twice the volume of the outlet chamber. Component 400 can be placed between any number of other components to provide a two chamber septic tank of variable length. It is to be understood that component 400 can also be used as an end unit.

Referring once again to FIG. 2, adjacent components are provided with flange-like protrusions or indentations that permit the components to be nested together without interrupting the circular cross-section of the tank throughout its length. To create the necessary compression, the components are cast so that four post-tension cables 8 can be routed through the four aligned chase ways, 22, 24, 32 and 34 in the casting. These cables are tightened after the components are aligned and pushed together thus causing the components to compress tightly together under tension and act as one single monolithic unit. Once the cables are stressed and elongated using, for instance, a hydraulic pump and ram (as described, for example, in the *Field Procedures Manual For Unbonded Single Strand Tendons*, Second Edition, Post-Tensioning Institute, 1994), the compression at the active joints effectively eliminates the component behavior and the structural value is as if the tank was cast as a single, monolithic unit. The active, constant compression is designed to create structural integrity in the tank. These cables may be designed to provide an active joint to meet the design criteria of the tank due to the tensioning properties of post tension technology. Tension is placed on the cables by employing a standard post tension pump, ram and wedge (represented by block 60 in FIG. 2), that are common to post tension technology. Block 60 is intended to reflect any one of a number of different types of tensioning means known in the prior art, having various sizes and shapes. As is common to posttensioning procedures, a jack may be used to pull the cables with the reaction acting against the precast concrete components. The jack can pull individual cables one at a time, or a plurality of cables all at the same time. After the cables have been prestressed, an end anchorage (not shown) that is mounted to the ends of the cables 8 can be enclosed in concrete to protect against corrosion and fire. Having described the utilization of the chase ways 22, 24, 32, and 34 to accommodate post-tension cables, it is now apparent why the widths of the top and bottom should not be less than approximately the inner diameter d of the body. If the widths of the top and bottom are made less than the inner diameter d, very little material is saved. However, decreasing the width of the top 20 necessarily decreases the horizontal separation of the chase ways 22 and 24. Similarly, decreasing the width of the bottom 30 necessarily decreases the horizontal separation of the chase ways 32 and 34. When the tank is assembled, decreased horizontal separation of the post-tension cables decreases the lateral resistance of the tank to horizontal bending forces. Thus, if the horizontal distance between the post-tension cables is reduced, the tank is easier to bend laterally, and leaks are more likely to occur along the outer periphery of the bend. Moreover, if the width of the top 20 and bottom 30 is decreased, the minimum thickness of the top 20 and bottom 30 may have to be increased in order to provide room for the chase ways 22, 24, 32, and 34. Thus, decreasing the width of the top and bottom may not actually require less material, and will certainly weaken the structure.

Furthermore, having explained the post-tension cabling, another disadvantage of increasing the width or minimum thickness of the top 20 or bottom 30 becomes apparent. Either increasing the width or minimum thickness of the top 20 or bottom 30 increases the total surface area of contact between the component and its adjacent components. According to the present invention, the seal between components is formed by providing a certain amount of pressure at the interfaces. Pressure is force per unit area. If the total area of the interface is increased, the total force which must be applied by the post-tension cable must therefore correspondingly increase to maintain a certain amount of pressure and thus maintain the seal. A higher force requirement for the post-tension cables complicates installation of the cables, and may limit the size or length of the tank for a fixed post-tension cable type.

For all the above reasons, the width and minimum thickness of the top 20 and the bottom 30 are believed to represent the optimum shape of the component in terms of costs, strength, and versatility.

If desired, cables 8 can be replaced by bars which are either bonded or unbonded to the concrete. Bars are generally not as strong as the cables, but are easier to handle and cheaper to anchor in some instances.

A general description of post tension technology as well as the particulars described above is disclosed in a publication to T. Y. Lin and N. H. Burns, entitled "Design of Prestressed Concrete Structures, Third Edition", Chapter 3, pp 67–86, published by John Wiley & Sons (1971).

The amount of tension placed on the cables can be regulated depending on desired compression. By using this method of tensioning and compression, the cables are kept out of contact with the natural elements and out of contact with any materials that would shorten its expected life span.

This tensioning method is better than the connection methods taught in the prior art because by using post-tension cables that extend throughout the entire length of each component, each component is thereby connected to each cable to create an integral unit. Whereas with inferior methods, each component is only connected to an adjacent component. As a result there is no structural integrity between components that are not directly adjacent to one other. The structural integrity provided by the present invention helps maintain the tank in a fluid tight state even when the ground below one or more components fails to provide adequate support. At the same time, the portable aspects of the present invention are preserved.

While the present invention is described above with reference to specific embodiments discussed in the specification and shown in the drawings, it is to be understood that those embodiments are intended by way of example and are not intended to be limits upon the scope or spirit of the present invention as defined in the appended claims.

What is claimed is:

1. A precast concrete component for use in a multicomponent tank system comprising:

a generally cylindrical body having an outer surface, a wall thickness, and an inner surface, the inner surface having a cross-sectional diameter, and a length;

a first rectangular region formed on a first portion of the outer surface of the cylindrical body having a width approximately equal to the cross-sectional diameter of the inner surface of the cylindrical body and extending along the length of the cylindrical body, and having a first minimum thickness approximately equal to said wall thickness, the first rectangular region having a planar top surface;

a second rectangular region formed on a second portion of the outer surface of the cylindrical body diametrically opposed to the first portion having a second minimum thickness approximately equal to said wall thickness and having a planar bottom surface that is parallel to said planar top surface; and wherein each of said first and second rectangular regions includes a plurality of chase ways running substantially parallel to said length through which post-tension cables can be routed.

2. The apparatus according to claim 1, wherein the inner surface of the cylindrical body has an uninterrupted circular cross-section throughout the length of the cylindrical body.

3. A multi-component tank comprising:

a first end component having a first end wall;

a second end component having a second end wall;

a plurality of intermediate components disposed between said first end component and said second end component to form a line of components that define one or more interior regions for storing fluids; and post-tensioning means for providing a compressive force to the line of components by applying a force to said first and second end components by stressing and elongating post-tension cables so that said force is distributed throughout the line of components thereby providing pressure at each component junction so that a fluid tight seal exists between each of the components;

wherein each of said first component, said second component, and said plurality of intermediate components includes a generally cylindrical body having an outer surface, a wall thickness, and an inner surface, the inner surface having a cross-sectional diameter, and a length;

a first rectangular region formed on a first portion of the outer surface of the cylindrical body having a width approximately equal to the cross-sectional diameter of the inner surface of the cylindrical body and extending along the length of the cylindrical body, and having a first minimum thickness approximately equal to said wall thickness, the first rectangular region having planar top surface;

a second rectangular region formed on a second portion of the outer surface of the cylindrical body diametrically opposed to the first portion having a second minimum thickness approximately equal to said wall thickness and having a planar bottom surface that is parallel to said planar top surface; and wherein each of said first and second rectangular regions includes a plurality of chase ways running substantially parallel to said length through which post-tension cables can be routed.

4. The multicomponent tank according to claim 3, wherein said post-tensioning means includes post-tension cables passed through chase ways formed within each component.

5. The multicomponent tank according to claim 3, wherein each interior region of said one or more interior regions has a circular cross-section.

6. The multicomponent tank according to claim 3, wherein said first end wall and said second end wall are each provided with openings for access to an inlet or an outlet.

7. The multicomponent tank according to claim 6, wherein one of said plurality of intermediate components has a wall which divides said multicomponent tank into a dual-chambered septic tank, the wall being provided with an opening to permit fluid flow from one side of the wall to the other.

8. The multicomponent tank according to claim 3, wherein the post-tensioning means employs bars that are passed through chase ways provided in each component.

9. A multi-component tank comprising:

a first end component having a first end wall;

a second end component having a second end wall;

an intermediate component disposed between said first end component and said second end component to form a series of components that define one or more interior regions for storing fluids; and post-tensioning means for providing a compressive force to the series of components by applying a force to said first and second end components by stressing and elongating post-tension cables so that said force is distributed throughout the series of components thereby providing pressure at each component junction so that a fluid tight seal exists between each of the components and so that the series of components acts as a single monolithic unit;

wherein each of said first component, said second component, and said intermediate component includes a generally cylindrical body having an outer surface, a wall thickness, and an inner surface, the inner surface having a cross-sectional diameter, and a length;

a first rectangular region formed on a first portion of the outer surface of the cylindrical body having a width approximately equal to the cross-sectional diameter of the inner surface of the cylindrical body and extending along the length of the cylindrical body, and having a first minimum thickness approximately equal to said wall thickness, the first rectangular region having a planar top surface;

a second rectangular region formed on a second portion of the outer surface of the cylindrical body diametrically opposed to the first portion having a second minimum thickness approximately equal to said wall thickness and having a planar bottom surface that is parallel to said planar top surface; and wherein each of said first and second rectangular regions includes a plurality of chase ways running substantially parallel to said length through which post-tension cables can be routed.

10. The multicomponent tank according to claim 9, wherein said post-tensioning means includes post-tension cables passed through chase ways formed within each component.

11. The multicomponent tank according to claim 9, wherein each interior region of said one or more interior regions has a circular cross-section.

12. The multicomponent tank according to claim 9, wherein said first end wall and said second end wall are each provided with openings for access to an inlet or an outlet.

13. The multicomponent tank according to claim 9, wherein said intermediate component has a wall which divides said multicomponent tank into a dual-chambered septic tank, the wall being provided with an opening to permit fluid flow from one side of the wall to the other.

14. The multicomponent tank according to claim 3, wherein the post-tensioning means employs bars that are passed through chase ways provided in each component.

* * * * *